United States Patent [19]

Blessing et al.

[11] 4,138,957

[45] Feb. 13, 1979

[54] VACUUM THREAD CUTTER FOR USE IN AN AUTOMATED TEXTILE SEWING OPERATION

[75] Inventors: Hubert Blessing, Dallas; Ted M. Ray, Plano, both of Tex.

[73] Assignee: Levi Strauss & Company, San Francisco, Calif.

[21] Appl. No.: 849,076

[22] Filed: Nov. 7, 1977

[51] Int. Cl.[2] ..... D05B 65/00

[52] U.S. Cl. ..... 112/287; 112/288

[58] Field of Search ..... 112/285, 288, 287

[56] References Cited

U.S. PATENT DOCUMENTS

| | | | |
|---|---|---|---|
| 2,712,805 | 7/1955 | Peterson et al. | 112/288 X |
| 3,025,811 | 3/1962 | Kostenowkzyk | 112/288 |
| 3,380,416 | 4/1968 | Du Buis et al. | 112/288 X |
| 3,407,763 | 10/1968 | Davidson | 112/288 |
| 3,494,315 | 2/1970 | Washburn | 112/287 |
| 3,557,730 | 1/1971 | Armstead | 112/287 |
| 3,581,716 | 1/1971 | Teed | 112/287 X |
| 3,712,256 | 1/1973 | Striegler et al. | 112/288 |
| 3,749,040 | 7/1973 | Jurgens | 112/288 X |
| 3,815,533 | 6/1974 | Bray | 112/288 X |
| 3,924,554 | 12/1975 | Cummins | 112/287 |

FOREIGN PATENT DOCUMENTS

| | | | |
|---|---|---|---|
| 1945310 | 4/1971 | Fed. Rep. of Germany | 112/288 |
| 2021649 | 11/1971 | Fed. Rep. of Germany | 112/288 |

*Primary Examiner*—Ronald Feldbaum

*Attorney, Agent, or Firm*—Limbach, Limbach & Sutton

[57] ABSTRACT

A cutter for severing work pieces chained together and for removing thread in close proximity to the work piece, such as on leading and trailing edges. The cutter of the invention permits close proximity of adjacent work pieces during the process of sewing but is still able to cut and remove free thread without necessitating undue slack as normally required with a shear type cutter (unlike a guillotine type cutter), or similarly can remove trailing thread between the work piece and the sewing machine.

8 Claims, 15 Drawing Figures

VACUUM THREAD CUTTER FOR USE IN AN AUTOMATED TEXTILE SEWING OPERATION

BACKGROUND OF THE INVENTION

This invention relates generally to textile thread cutters, and more particularly to such cutters that utilize a vacuum source and that are employed as part of a continuous sewing operation immediately after stitching by a sewing machine.

Vacuum thread cutters are generally well known, as exemplified by U.S. Pat. Nos. 2,356,378 (Capolupo (1943); 2,607,101 — Stout (1952); and 3,557,730 — Armstead (1971). In this type of mechanism, a vacuum system is used to pull trailing chain stitch threads through a cutting element as the sewn cloth leaves a sewing machine. The vacuum both holds the thread in position for the cutters and removes the cut thread from the work station.

A problem common to most of such prior art trimmers when used with an automated sewing machine operation is that because the workpiece is removed automatically at a relatively rapid rate, the trailing chain stitch is drawn taut and passes over the cutting shears without being severed. The result is that the workpiece is still tethered to the sewing machine and is pulled free to the workpiece removal mechanism, thereby upsetting the sequence of operations of the entire automated system. One way to overcome this problem is to ensure that during removal of the workpiece from the sewing machine, slack is allowed to occur in the chain stitch. The slack in the chain stitch can then be sucked by a vacuum line into engagement with the cutting shears. This, however, necessitates that there be a pause in the removal operation which slows the severing operation.

It is a principal object of the present invention to provide an improved vacuum head thread cutter that positively severs a sewn workpiece from the sewing needle without the necessity of slowing the removal of the sewn workpiece from the sewing machine.

It is another object of the present invention to provide such an improved vacuum thread cutter that operates at increased rates of speed of cloth travel over the cutting station.

SUMMARY OF THE INVENTION

These and additional objects are accomplished by the structure of an improved vacuum head thread cutter according to the present invention wherein a trailing stitch chain from a sewn workpiece which is being automatically removed from a sewing machine is passed immediately over a vacuum throat and then over an upright thread cutter adjacent to the vacuum head, the cloth workpiece being held down against the cutting head by resilient elements on both sides thereof. The vacuum throat is shaped to provide a downward pull on threads from the cloth before they reach the cutting head, and after reaching the cutting head to pull the threads through the cutting head mechanism as well. The result is that threads to be cut are properly oriented long before reaching the cutting elements and are, once the threads reach the cutting elements, drawn therethrough, all resulting in short cuts of the thread. The cloth workpiece is permitted to move at high rates of speed because it is not necessary to allow slack to occur in the trailing stitch chain. The increased speed of cloth movement that is permitted increases the productivity of automatic sewing equipment.

Additional objects, advantages and features of the present invention are explained as part of the following detailed description which should be taken in conjunction with the accompanying drawings.

DESCRIPTION OF A PREFERRED EMBODIMENT

Figure 1:
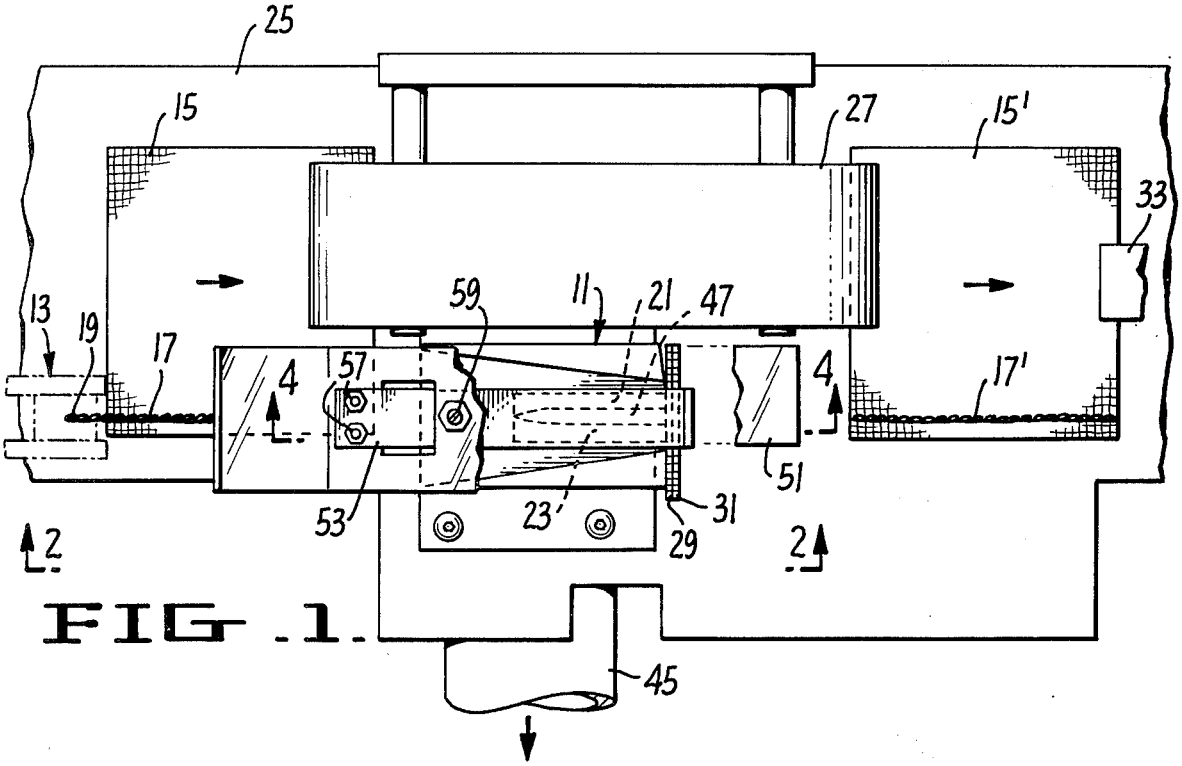
FIG. 1 is a plan view, with portions broken away, showing a preferred embodiment of a vacuum thread cutter according to the present invention utilized at the output of an automated sewing device.

Referring initially to FIG. 1, a vacuum head (trimmer block) 11 is positioned a few inches away from a standard sewing machine needle and presser foot assembly 13. The head 11 is positioned to receive a fabric piece 15, after it has first been stitched, a threaded stitch 17 being illustrated in FIG. 1.

Figure 2:
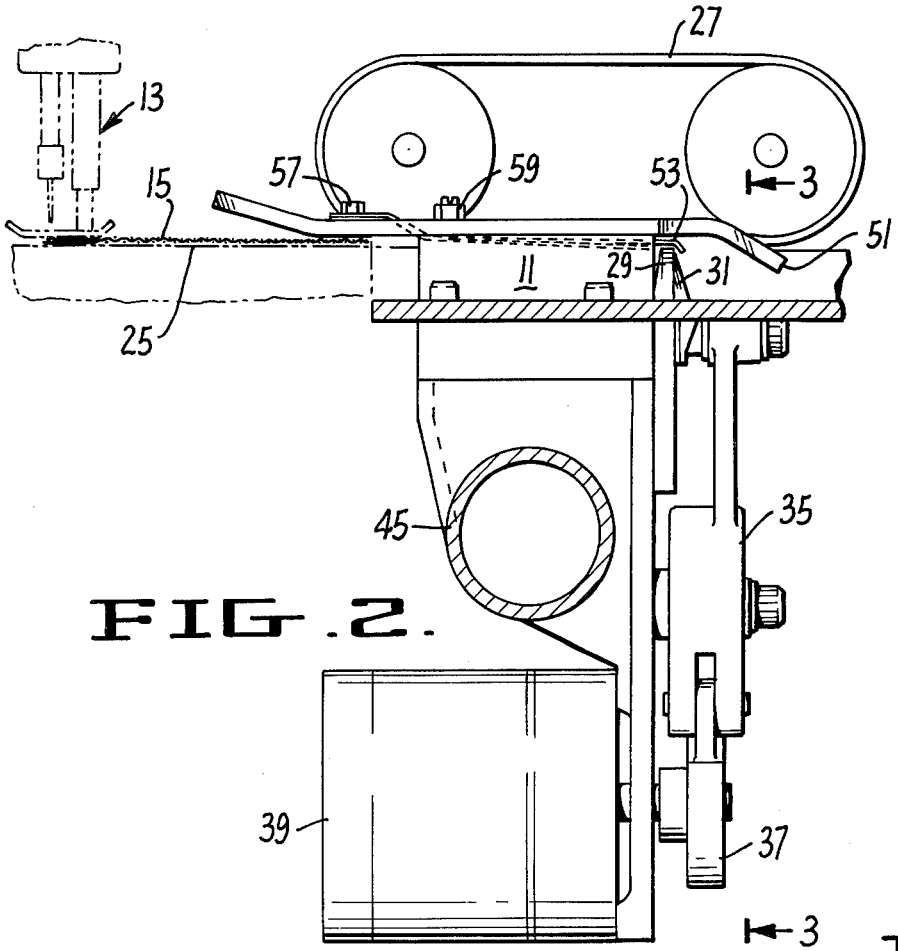
FIG. 2 is a vertical, sectional view of the assembly of FIG. 1 taken at section 2—2 thereof.

A trailing stitch chain 19 extends from the needle of the sewing machine assembly 13 to the trailing edge of the fabric piece 15. The vacuum head 11 is furthermore positioned so that the trailing thread chain 19 from the sewing operation will tend to drop into channel shaped openings 21 and 23 of the head 11 under the influence of a reduced air pressure therein. Since the thread chain 19 is somewhat taut, however, it is necessary to provide means for mechanically forcing the thread chain 19 to travel into the channel shaped openings 21 and 23. This function is accomplished by a pair of leaf springs 51 and 53 (FIG. 2) as will be explained in greater detail further herein.

In this automatic sewing operation, the cloth is automatically moved from the sewing station to the vacuum thread cutter and thence on to its next operation along a work surface 25 by an overhead, motorized belt 27. The work surface 25 is generally flat except for the apertures 21 and 23 into which the trailing thread chain 19 is caused to drop. A pair of thread shearing elements 29 and 31 are positioned generally upright beneath the surface 25 in order to sever the thread chain 19 from the fabric 15 as it is passed thereover. After the thread chain 19 is severed from the fabric 15, the fabric proceeds onward to the next operation, in a manner such as shown by the fabric piece 15' being pulled by a movable fabric gripping element 33.

Figure 3:
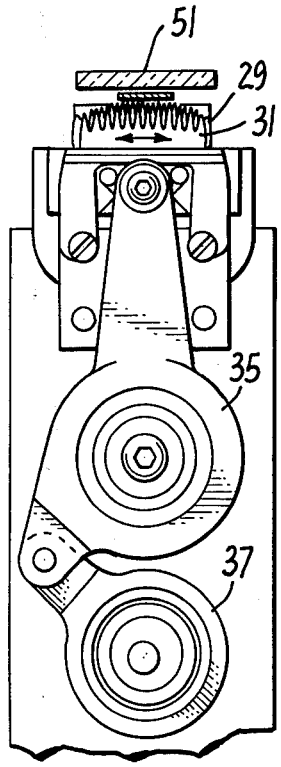
FIG. 3 is a vertical view of a portion of the assembly of FIGS. 1 and 2 taken at section 3—3 of FIG. 2.

The actual thread cutting elements are preferably powered shears; that is, a set of stationary upright teeth 29 (see FIG. 3) has knife-like edges within its V-grooves. A cooperating element 31 is held for reciprocation back and forth in the direction shown by the arrow in FIG. 3 immediately against the stationary member 29. The plane where the principal cutting action occurs is the intersection of the stationary element 29 with the moving element 31, these elements being oriented so that the plane is substantially orthogonal to the plane of the work surface 25 and thus to the path taken by the fabric 15 as it is passed thereover. Reciprocal motion is provided to the moving element 31 of the cutting assembly, such as by a crank 35 and an eccentric 37 operably connected to an electric motor 39 and to each other in a manner to provide the desired rocking motion of the element 31.

The particular shape of the vacuum head 11 is shown in detail, particularly by FIGS. 7–11. The top elongated openings 21 and 23 are formed in a top, substantially planar surface 12 which is inclined upwardly from the work surface 25 in the direction of fabric travel, from left to right as viewed in the figures. The openings 21 and 23 are part of a vacuum throat 41 that opens downwardly. The throat 41 is connected with a vacuum chamber 43 (FIG. 4) from which a vacuum tube 45 extends for interconnection with a vacuum pump (not shown) of a standard type. By reducing the pressure in the chamber 43 and the throat 41 with the vacuum pump, the trailing thread chain 19 is drawn downwardly thereinto as the cloth passes over the vacuum thread cutter assembly 29 and 31. The vacuum is drawn through the top surface openings 21 and 23.

A cantilevered support element 47 separates the vacuum throat into the elongated openings 21 and 23 and helps support the fabric being drawing thereover.

Figure 4:
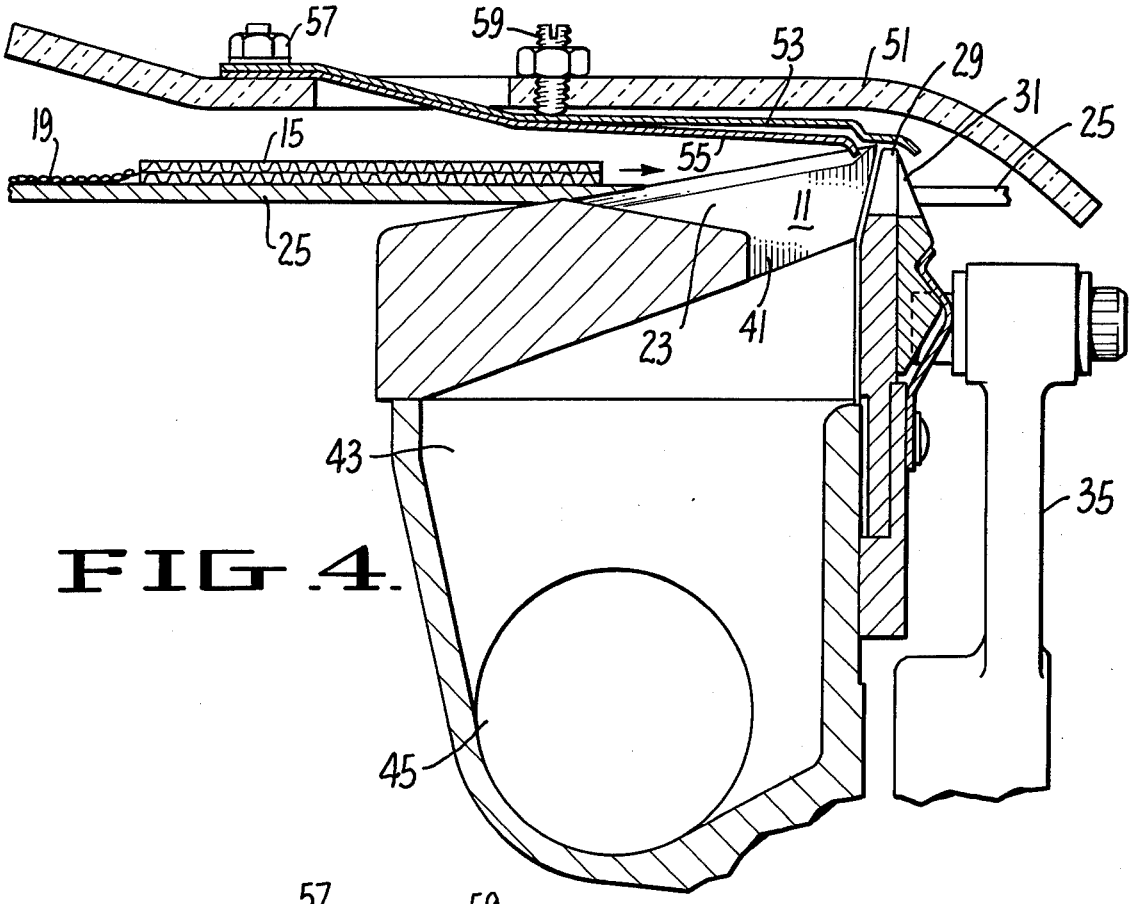
FIG. 4 is an enlarged vertical sectional view of the vacuum head thread cutter assembly of FIGS. 1–3 taken at section 4—4 of FIG. 1.
Figure 5:
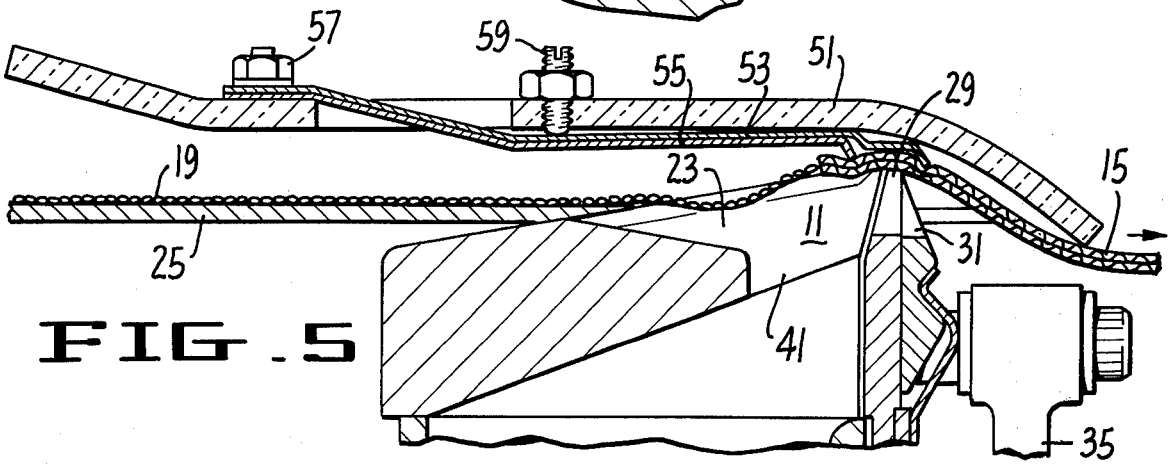
FIGS. 5 and 6 are enlarged views which illustrate the operation of the vacuum thread cutter of FIGS. 1–4 by showing different portions of cloth having trailing threads thereon in the view of FIG. 4.
Figure 6:
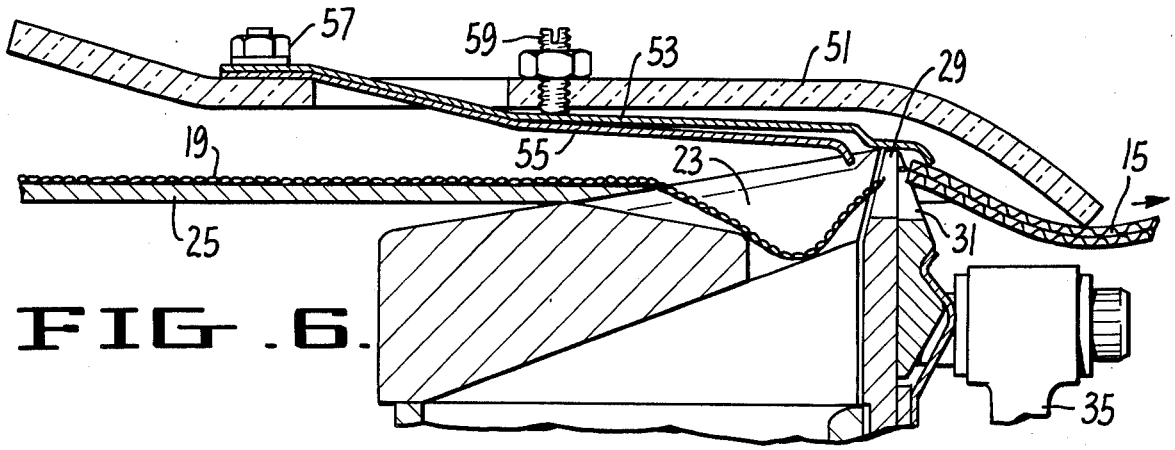
Figure 7:
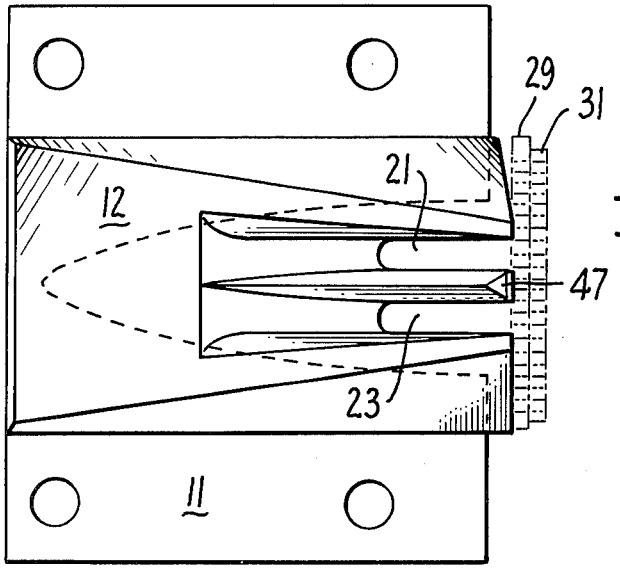
FIG. 7 is an enlarged plan view of a vacuum head component of the assembly of FIGS. 1–6.
Figure 8:
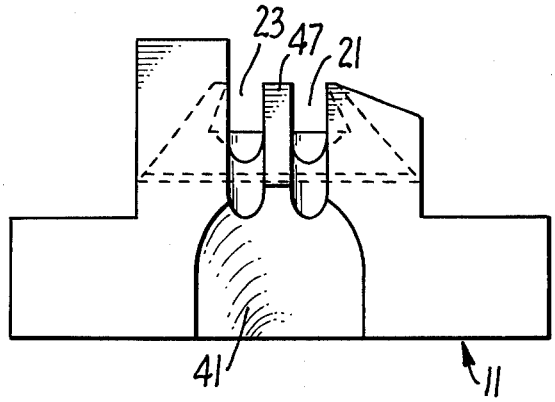
FIG. 8 is an enlarged end view of the vacuum head block of FIG. 7.
Figure 9:
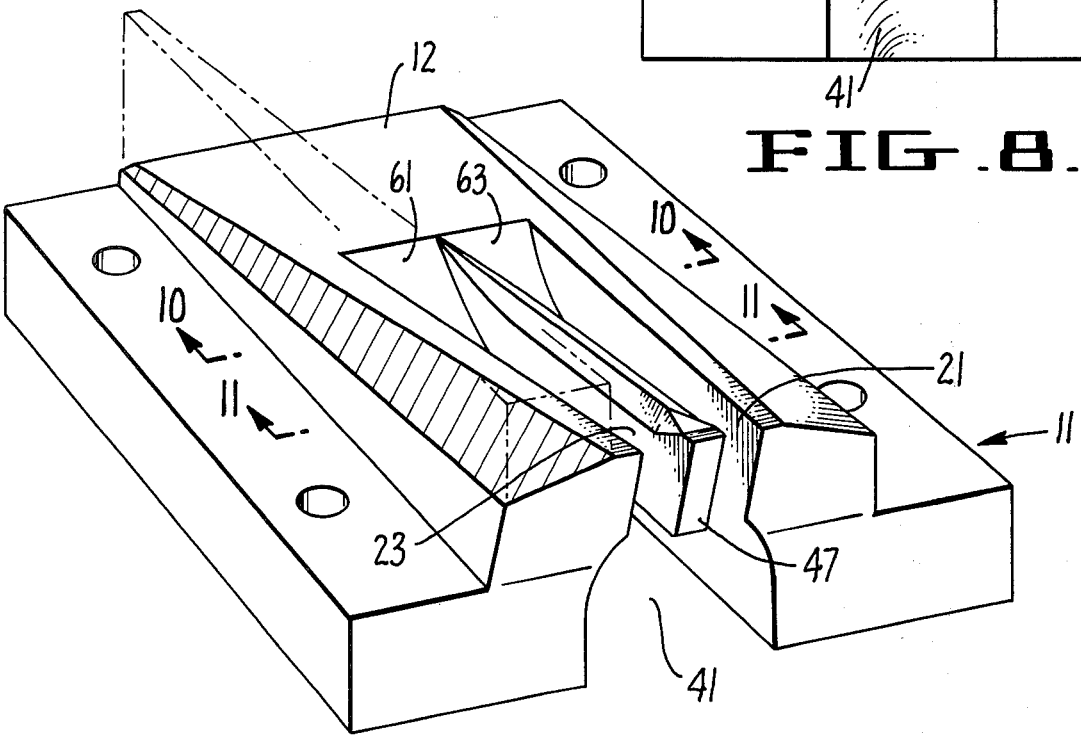
FIG. 9 is an enlarged perspective view of the vacuum head of FIGS. 7 and 8.
Figure 10:
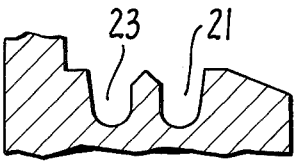
FIGS. 10 and 11 are enlarged, vertical sectional views of a portion of the vacuum head of FIGS. 7–9 taken at sections 10—10 and 11—11, respectively, of FIG. 9.
Figure 11:
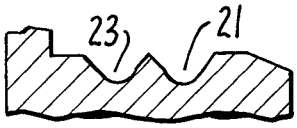
Figure 12:
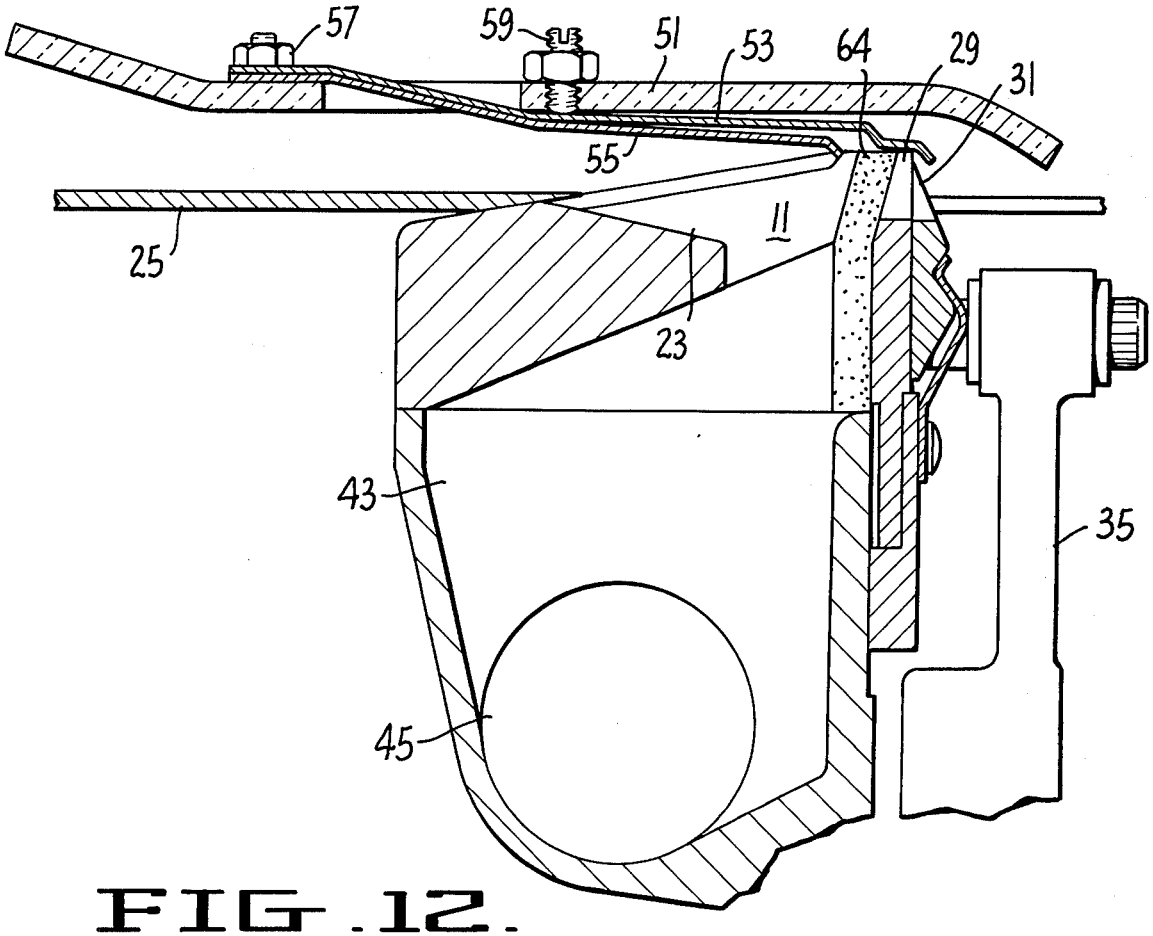
FIGS. 12, 13, 14 and 15 depict a modified embodiment of the invention and correspond, respectively, to FIGS. 4, 3, 7 and 6.
Figure 15:
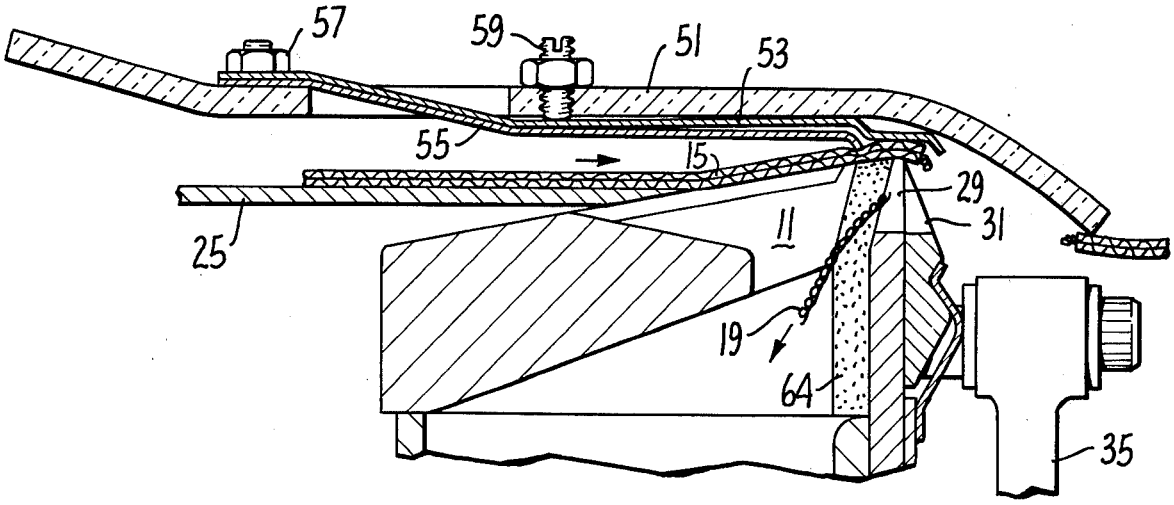
Figure 14:
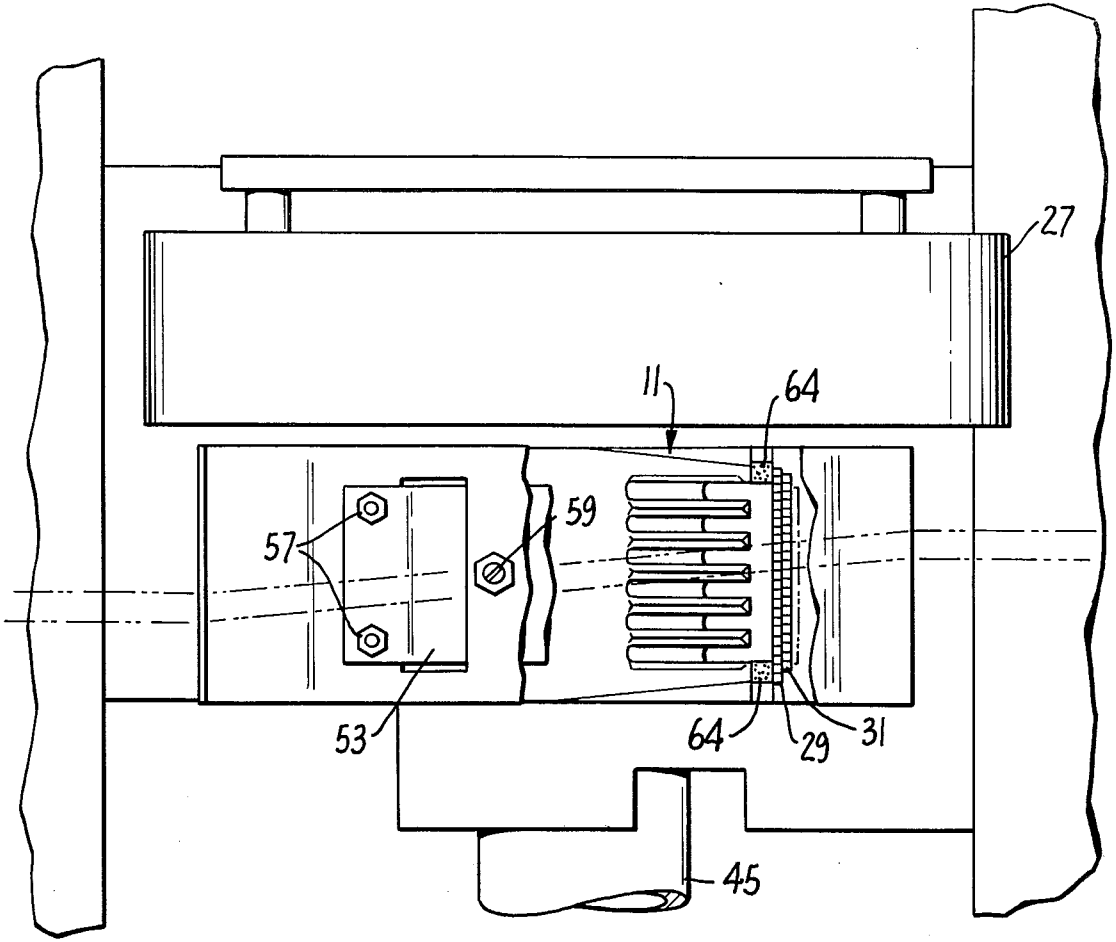
Figure 13:
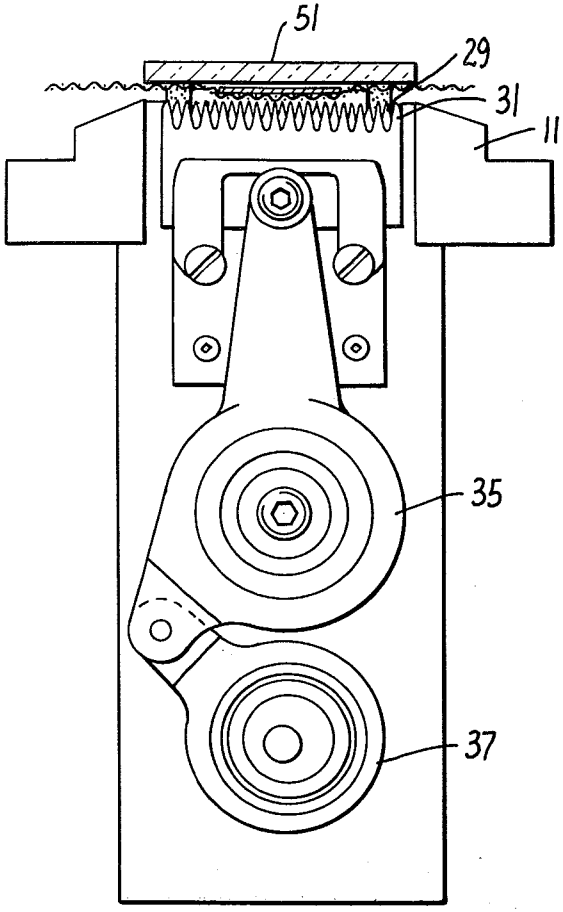

Additional details of the shape of the vacuum head 11 as shown in FIGS. 7–11 can best be appreciated by reviewing its operation as shown in FIGS. 4–6. The top surface 12 of the block is oriented to provide a small acute angle with the work surface 25 in order to provide a ramp upon which the fabric 15 entering the thread cutting station can easily be accepted. A transparent plastic top guide 51 is provided to hold that portion of the fabric passing over the vacuum head 11 generally downward against the vacuum head 11 as well as to help direct the vacuum force.

Attached to this guide 51 are two leaf springs 53 and 55. They are attached at one end by an appropriate fastener 57 with the opposite ends of the leaf springs being free. The free end of the leaf spring 53 is shaped to depend downward on one side of the cutting blades while the free end of the leaf spring 55 is shaped to depend downwardly on an opposite side of the cutting assembly. The purpose of these leaf springs is to resiliently urge cloth passing through the cutting assembly downward on both sides of the cutting blade, as is best illustrated in FIG. 5, to thereby force the taut trailing stitch chain 19 to pass through the cutting blades 29 and 31.

The rest position of the leaf springs 53 and 55 is adjusted by an appropriate adjustable stop member 59. As is best shown in FIG. 1, the width of each of the leaf springs 53 and 55 is substantially the same as the width of the vacuum throat 41 and its upper surface thereof wherein it has the form of the openings 21 and 23.

Referring now more particularly to FIGS. 7–11, the initial portion of the vacuum throat openings 21 and 23 taken in the direction of travel of the cloth piece 15, are downwardly sloping depressions 61 and 63 on opposite sides of the elongated support 47. The beveled top edge shape of the divider 47 permits the threads 19 of a piece of cloth passing thereby to drop down into the openings 61 and 63. The depressions 61 and 63 slope downward in the direction of travel of the threads until joining the main throat area 41 at which point, as illustrated best in FIG. 5, the threads are permitted to drop downward through the throat 41 under the influence of gravity and the partial vacuum therein. The leaf springs 53 and 55 urge the cloth 15 downward against the cutting elements 29 and 31 in a manner to bow the cloth thereover. As shown best in FIG. 6, the trailing edge of the fabric 15 drops downward after passing through the cutting blades, thereby placing the undesired thread chain 19 squarely between cutting blade teeth. This cloth action is contributed to by the plastic guide member 51 whose lowest most edge is lower than the teeth of the cutting elements 29 and 31, as best shown in FIG. 6.

Referring now more particularly to FIGS. 12–15, a modified embodiment of the invention is disclosed. In this modified embodiment, the vacuum head 11 is spaced from the stationary cutting members 29 by a distance of from 0.2 to 0.3 inches. The outside edges of the vacuum head 11 which are immediately adjacent to the stationary cutting blade 29 are provided with a sponge rubber gasket 64 to prevent undue air leakage into the intervening space. The purpose of the gap is that if a thread passing through the middle of a workpiece is not in alignment with the openings 21 and 23 of the vacuum head, the gap between the vacuum head 11 and the stationary cutting blade 29 will allow the thread to move perpendicular to the direction of sewing and therefore will fall into the slot or gap between the vacuum head 11 and the stationary cutting blade 29. The thread will thereby be prevented from sliding over the top of the teeth in the stationary cutting blade 29.

Although the various aspects of the present invention have been described with respect to a preferred embodiment thereof, it will be understood that the invention is entitled to protection within the full scope of the appended claims.

What is claimed is:

1. A thread cutter of a type employing a vacuum device for severing a trailing stitch chain from a cloth workpiece, comprising:

a block having a workpiece support surface and a vacuum throat opening therethrough at one of the block's corner edges, a cutting mechanism adjacent the one corner edge of the block with a pair of thread cutting blades positioned to move substantially transversely with respect to the workpiece supporting surface, means for guiding the workpiece along the workpiece supporting surface of the block in a direction thereacross over the throat opening therein and toward the corner edge and the cutting blades, resilient means for curving the workpiece over the corner edge and the cutting blades to force the trailing stitch chain into engagement with the cutting blades as the workpiece is guided over the block by the guiding means.

2. A thread cutter as recited in claim 1, wherein the resilient means include a pair of leaf springs positioned parallel to the workpiece supporting surface, each of said springs having one end which is bent toward the workpiece supporting surface, with one of said springs terminating at its bent end before the cutting blades and the other terminating at its bent end after the cutting blades, taken with respect to the direction of travel of the workpiece in passing through the cutter.

3. A thread cutter as recited in claim 1, wherein the block includes an elongated support element within the vacuum throat opening and extending along the direction of workpiece travel to the block corner edge for supporting the workpiece against being drawn into the vacuum throat.

4. A thread cutter of a type employing a vacuum device comprising:

a block having two adjacent surfaces which join at a common corner edge and a vacuum throat opening therethrough, a cutting mechanism adjacent one of the block surfaces with a pair of thread cutting blades substantially parallel to one of the block surfaces over the throat opening of the one surface, means for guiding cloth having trailing threads to be cut along the other surface of the block in a direction thereacross over the throat opening therein toward the edge and the cutter, the cloth guiding means further including resilient elements for holding the cloth toward the block and the cutting mechanism at positions immediately on either side of the cutting blades, and vacuum means for reducing the air pressure within said vacuum throat.

5. The thread cutter according to claim 4, wherein each of the cutter blades include a plurality of upwardly pointing edge sharpened teeth adjacent the block edge, one blade being fixed with respect to the block and the other positioned on an opposite side of the fixed blade from the block and provided with means for reciprocating the other blade with respect to the fixed blade.

6. A thread cutter according to claim 4, wherein the block includes an elongated support element within the vacuum throat extending along the direction of cloth travel to the block edge for supporting the cloth against being drawn into the vacuum throat.

7. A system for cutting undesired trailing threads from a cloth workpiece after passing through a sewing machine, comprising:

means for moving the cloth workpiece from the sewing machine through a thread cutting station, a thread cutter oriented across the path of the cloth workpiece and underneath it at the thread cutting station, the cutter including reciprocating knife elements operating in a plane generally orthogonal to the path of the cloth workpiece, means beneath the cloth workpiece path at the cutting station for drawing a vacuum downward through a segment of the cloth workpiece prior to the cutting element and also for drawing a vacuum through the cutting element, and means including resilient elements above the path of the cloth workpiece for urging the cloth workpiece downward at locations on each side of the cutting element, whereby the vacuum means draws trailing threads downward from the cloth prior to going through the cutting elements.

8. A system for cutting undesired trailing threads from a cloth workpiece as recited in claim 7, wherein the means for drawing a vacuum comprise a vacuum source, a ramp shaped vacuum head block for supporting the workpiece immediately prior to the cutting element, the vacuum block having an open-ended vacuum throat which is in communication with the vacuum source and a plurality of workpiece support elements extending across the open end of the throat, the vacuum head block being located immediately adjacent to, but spaced apart from the cutter to define a gap therebetween, the gap being in communication with the vacuum throat and means for sealing the edges of the gap except immediately adjacent to the path of travel of the workpiece in passing to the cutter.

* * * * *